US008870362B2

(12) United States Patent
Kawasaki et al.

(10) Patent No.: US 8,870,362 B2
(45) Date of Patent: Oct. 28, 2014

(54) INKJET PRINTER HAVING A PAPER EDGE COVER

(75) Inventors: Koji Kawasaki, Matsumoto (JP); Masataka Hirabayashi, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 351 days.

(21) Appl. No.: 13/217,154

(22) Filed: Aug. 24, 2011

(65) Prior Publication Data

US 2012/0050439 A1 Mar. 1, 2012

(30) Foreign Application Priority Data

Aug. 25, 2010 (JP) ..... 2010-187956
Aug. 25, 2010 (JP) ..... 2010-187957

(51) Int. Cl.
*B41J 2/01* (2006.01)
*B41J 11/30* (2006.01)
*B41J 29/12* (2006.01)

(52) U.S. Cl.
CPC . *B41J 11/30* (2013.01); *B41J 29/12* (2013.01)
USPC ..... 347/104

(58) Field of Classification Search
CPC ..... B41J 11/0055; B41J 13/16; B41J 17/16; B41J 17/20; B41J 11/005; B41J 11/32; B41J 11/34
See application file for complete search history.

(56) References Cited

U.S. PATENT DOCUMENTS 3,960,304 A * 6/1976 Holland-Letz ..... 226/74
4,729,682 A 3/1988 Morita
4,822,192 A 4/1989 Morita
5,847,747 A * 12/1998 Ishikawa ..... 347/262
6,033,067 A * 3/2000 Kakizaki et al. ..... 347/104
6,736,501 B2 5/2004 Yamaguchi et al.
2005/0093901 A1 * 5/2005 Yraceburu et al. ..... 347/9
2007/0109387 A1 * 5/2007 Tanabe ..... 347/104
2009/0244175 A1 10/2009 Kojima
2010/0209169 A1 * 8/2010 Mandel et al. ..... 400/619

FOREIGN PATENT DOCUMENTS

JP 61-115661 U 7/1986
JP 62-102553 U 6/1987
JP 63254080 A * 10/1988
JP 2000-006387 A 1/2000
JP 2000-168060 A 6/2000
JP 2002-321409 A 11/2002
JP 2005-001303 A 1/2005
JP 2009-234785 A 10/2009

* cited by examiner

*Primary Examiner* — Matthew Luu
*Assistant Examiner* — Tracey McMillion
(74) *Attorney, Agent, or Firm* — Kilpatrick Townsend & Stockton LLP

(57) ABSTRACT

An inkjet printer (1) has an inkjet head (7), a paper conveyance path (6) that conveys tractor feed paper (2) passed the printing position P of the inkjet head (7), and a pair of paper edge covers (21L, 21R) disposed on the opposite sides of the conveyance path portion passing the printing position P of the paper conveyance path (6). The paper edge covers (21L, 21R) are covers that cover and hide the edge portions (2L, 2R) where the sprocket holes (2*a*) of the tractor feed paper (2) conveyed passed the printing position P are formed from the inkjet head (7). The paper edge covers (21L, 21R) can reliably prevent problems such as nozzle clogging caused by paper dust from the sprocket holes (2*a*) at the edges of the tractor feed paper (2) clinging to the nozzle face (7*a*) of the inkjet head (7).

30 Claims, 17 Drawing Sheets

INKJET PRINTER HAVING A PAPER EDGE COVER

This application claims priority to Japanese Patent Application No. 2010-187956, filed Aug. 25, 2010 and Japanese Patent Application No. 2010-187957, filed Aug. 25, 2010. The entireties of both of these applications are incorporated by reference herein.

BACKGROUND

1. Technical Field

The present invention relates to an inkjet printer configured so that paper dust and other foreign matter on the recording paper conveyed passed the printing position of the inkjet head does not stick on the inkjet head.

2. Related Art

One type of recording paper used for printing by inkjet printers is a continuous web of recording paper having feed holes called sprocket holes formed at a regular interval along both long edges of the paper. This type of paper is also known as tractor feed paper. Inkjet printers that print on tractor feed paper usually have a conveyance mechanism called a tractor that has sprockets for conveying tractor feed paper by repeatedly engaging and releasing the sprocket holes in tractor feed paper.

An inkjet printer with a tractor is taught, for example, in JP2005-1303A. In the inkjet printer described in JP2005-1303A, a tractor is disposed on both the upstream and downstream sides in the recording paper conveyance direction of the inkjet head printing position. A vacuum platen is also disposed to the inkjet head printing position on the recording paper conveyance path. The vacuum platen holds the recording paper flat and maintains a constant distance (platen gap) between the inkjet head and the printing surface of the recording paper by pulling the recording paper to the platen surface by means of suction.

When paper dust or other foreign matter on the recording paper sticks to the inkjet head side in this inkjet printer, the nozzles can become clogged, resulting in ink discharge problems. Much more paper dust is produced when using tractor feed paper than when using regular printing paper. More specifically, large amounts of paper dust cling to the tractor feed paper around the sprocket holes, and paper dust is easily thrown off by friction with the tractor sprocket. As a result, paper dust separates from the tractor feed paper and clings to the nozzle surface side of the inkjet head while the tractor feed paper is conveyed, and ink discharge problems, including clogged nozzles preventing ink droplet discharge, occur easily. Paper dust is also easily produced along both edges of regular printing paper.

SUMMARY

An inkjet printer according to the invention can prevent problems such as the nozzles of the inkjet head becoming clogged by paper dust or other foreign matter from both edges of the recording paper.

Another object of the invention is to provide an inkjet printer that can prevent problems such as the nozzles of the inkjet head becoming clogged by paper dust or other foreign matter from both edges of the recording paper when using different widths of recording paper.

Another object of the invention is to provide an inkjet printer that can prevent problems such as the nozzles of the inkjet head becoming clogged by paper dust produced from where sprocket holes are formed along both edges of tractor feed paper.

Another object of the invention is to provide an inkjet printer that can prevent problems such as the nozzles of the inkjet head becoming clogged by paper dust produced from where sprocket holes are formed along both edges of tractor feed paper when using different widths of tractor feed paper.

A first aspect of the invention is an inkjet printer including: an inkjet head; a paper conveyance path for conveying recording paper passed the printing position of the inkjet head; and a pair of paper edge covers disposed on both widthwise sides of the conveyance path at a portion of the paper conveyance path of a specific length at least including the printing position, the paper edge covers being covers for covering and hiding both widthwise edge parts of the recording paper from the inkjet head at least where the edges pass the printing position.

In an inkjet printer according to this aspect of the invention, the long edges of the recording paper conveyed passed the printing position are covered and hidden from the inkjet head by the pair of paper edge covers. Paper dust and other foreign matter on the edge parts of the recording paper passing the printing position can therefore be reliably prevented from being kicked up and adhering to the nozzle surface of the inkjet head. Poor ink discharge and loss of the ability to discharge ink resulting from paper dust or other foreign matter clinging to the nozzle surface of the inkjet head can therefore be prevented.

An inkjet printer can also be used to print as needed on recording paper of different widths. So that the paper edge covers can reliably cover and hide both side edge parts of the recording paper even when the paper width changes, the gap between the pair of paper edge covers widthwise to the conveyance path can preferably be adjusted. For example, at least one of the pair of paper edge covers is preferably a movable cover that can move widthwise to the conveyance path.

In another aspect of the invention, a cover portion that is positioned on the inkjet head side of the paper conveyance path, and a paper support portion that is opposite the cover portion with the paper conveyance path therebetween, are preferably disposed to the paper edge covers. The edge parts of the recording paper passing the printing position are guided by the paper support portions of the paper edge covers. The recording paper can therefore be smoothly conveyed passed the printing position.

Next, in order to enable reliably conveying the recording paper through the paper conveyance path when tractor feed paper is used as the recording paper, the inkjet printer preferably has a pair of tractors having a plurality of engaging parts that repeatedly enter and release conveyance holes while moving along an endless track. In this case, the width of the paper edge cover widthwise to the conveyance path is sized so that the paper edge covers can cover and hide the conveyance holes of the recording paper conveyed by the tractor. The conveyance hole portion of both edges of the recording paper passing the printing position can thus be covered and hidden by the pair of paper edge covers, and paper dust around the conveyance holes and paper dust thrown off from the conveyance holes can be reliably prevented from being kicked up and sticking to the inkjet head.

When tractors are used, the space between the tractor pair widthwise to the conveyance path can preferably be adjusted so that different widths of recording paper can be conveyed. In this case, if the gap between the pair of paper edge covers widthwise to the conveyance path is also adjusted when the tractor is adjusted, setting the gap to the paper width is easier than when the tractor gap and the paper edge cover gap are adjusted individually.

Further preferably, in order to adjust the gaps, at least one of the pair of tractors is a movable tractor that can move widthwise to the conveyance path; and at least one of the pair of paper edge covers is a movable cover that can move widthwise to the conveyance path in conjunction with the movable tractor.

The movable tractor and the movable cover can also be connected together by a connecting member in order to cause the movable tractor and the movable cover to move together. In addition, in order to move the movable cover smoothly in conjunction with the movable tractor, a cover guide shaft that guides the movable cover widthwise to the conveyance path, and a tractor guide shaft that guides the tractor widthwise to the conveyance path, can be provided to guide them. In this case, the connecting member preferably engages the cover guide shaft in a manner allowing only a specific amount of movement in the paper conveyance direction of the paper conveyance path.

If the connecting member engages the cover guide shaft with play, problems such as the connecting member twisting when the movable tractor is moved, and the connecting member being pushed against the outside of the cover guide shaft and becoming stuck and unable to move, can be avoided. As a result, the movable cover can be moved smoothly transversely to the conveyance path in conjunction with the tractor.

Another aspect of the invention is an inkjet printer that has an inkjet head; a paper conveyance path for conveying recording paper passed the printing position of the inkjet head; a pair of paper edge covers disposed to the paper conveyance path on both widthwise sides thereof at the portion of the paper conveyance path that at least passes the printing position; and a plurality of platens arrayed widthwise to the conveyance path for guiding the recording paper passed the printing position. The paper edge covers are covers for covering and hiding at least the widthwise edge parts of the recording paper passing the printing position from the inkjet head; at least one of the pair of paper edge covers is a movable cover that can move widthwise to the conveyance path; and at least the platen positioned in the range of movable cover movement is a movable platen that can move when pushed by the movable cover moving widthwise to the conveyance path.

Both side edge parts of recording paper passing the printing position are covered and hidden by the paper edge covers in an inkjet printer according to this aspect of the invention. Paper dust clinging to the edge parts of the recording paper, such as around the conveyance holes of the recording paper, and paper dust produced from this area, can therefore be reliably prevented from being kicked up and sticking to the nozzle surface of the inkjet head. In addition, because at least one of the pair of paper edge covers is a movable cover, both edge parts of the paper can be reliably covered and hidden even when different widths of recording paper are conveyed by moving the movable cover widthwise to the conveyance path, and paper dust from these edge parts of the paper can be prevented from sticking to the nozzle surface of the inkjet head.

In addition, the platen disposed to the printing position is segmented into plural parts widthwise to the conveyance path, and at least the platen positioned in the range of movable cover movement can be moved when pushed by the movable cover moving transversely to the conveyance path. Problems such as the platen located at the printing position obstructing movement of the paper edge cover transversely to the conveyance path according to the paper width can therefore be avoided.

Because the movable platen moves from the guide position where it guides the recording paper when pushed by the movable cover moving transversely to the conveyance path, a separate operation to move the movable platens is not needed, and both the movable cover and the movable platen can be easily moved.

Further preferably in another aspect of the invention, the platen located outside the movable range of the movable cover is a stationary platen disposed to a fixed position guiding the recording paper passed the printing position, thereby assuring an always constant platen gap.

The direction of movable platen travel may be any direction not interfering with movement of the movable cover. For example, the movable platen could be movable from the guide position in the direction away from the nozzle surface of the inkjet head, and normally held in the guide position by the urging force of a platen urging member. Alternatively, the movable platen could be movable from the guide position transversely to the conveyance path, and normally held in the guide position by the urging force of a platen urging member. Further alternatively, the movable platen could rock on a pivot shaft that extends widthwise to the conveyance path from the guide position in a direction away from the nozzle surface of the inkjet head, and normally held in the guide position by the urging force of a platen urging member.

Further preferably in another aspect of the invention, the paper edge covers include a cover portion that is positioned on the inkjet head side of the paper conveyance path, and a paper support portion that is opposite the cover portion with the paper conveyance path therebetween; and the paper support portion has an inside-projecting part extending further inside widthwise to the conveyance path than the cover portion, and a platen surface for guiding the recording paper passed the printing position formed on the surface of the inside-projecting portion. With this aspect of the invention, the recording paper passing the printing position is supported by the platen, and both edge parts of the recording paper are supported by the platen surface. An even platen gap can therefore be maintained across the full width of the recording paper.

Another aspect of the invention is an inkjet printer that has an inkjet head; a paper conveyance path for conveying recording paper passed the printing position of the inkjet head; a pair of paper edge covers disposed to the paper conveyance path on both widthwise sides thereof at the portion of the paper conveyance path that at least passes the printing position; a plurality of platens arrayed widthwise to the conveyance path for guiding the recording paper passed the printing position; and a pair of tractors that, in order to convey recording paper having conveyance holes formed at a specific interval along both widthwise edges through the paper conveyance path, have a plurality of engaging members that repeatedly enter and release the conveyance holes while moving along an endless track. The pair of paper edge covers are covers for covering and hiding at least the widthwise edge parts of the recording paper passing the printing position from the inkjet head; at least one of the pair of paper edge covers is a movable cover that can move widthwise to the conveyance path; at least the platen positioned in the range of movable cover movement is a movable platen that can move when pushed by the movable cover moving widthwise to the conveyance path; and the width of the paper edge covers widthwise to the conveyance path is sized to enable hiding and covering the conveyance holes of the recording paper conveyed by the tractor.

Further preferably, the gap between the pair of paper edge covers widthwise to the conveyance path is adjustable, the gap between the pair of tractors widthwise to the conveyance path is adjustable, and the gap between the pair of paper edge covers widthwise to the conveyance path is adjusted in conjunction with adjusting the tractor gap.

Further preferably, at least one of the pair of tractors can move widthwise to the conveyance path; and at least one of the pair of paper edge covers is a movable cover that can move widthwise to the conveyance path in conjunction with the movable tractor.

The inkjet printer according to another aspect of the invention preferably also has a connecting member that connects the movable tractor and the movable cover; a cover guide shaft that guides the movable cover widthwise to the conveyance path; and a tractor guide shaft that guides the tractor widthwise to the conveyance path. The movable cover connected to the connecting member engages the cover guide shaft in a manner allowing only a specific amount of movement (i.e., specific play) in the paper conveyance direction of the paper conveyance path.

Further preferably in an inkjet printer according to another aspect of the invention, the paper edge covers include a cover portion that is positioned on the inkjet head side of the paper conveyance path, and a paper support portion that is opposite the cover portion with the paper conveyance path therebetween; and the paper support portion has an inside-projecting part extending further inside widthwise to the conveyance path than the cover portion, and a platen surface for guiding the recording paper passed the printing position on the surface of the inside-projecting portion.

Other objects and attainments together with a fuller understanding of the invention will become apparent and appreciated by referring to the following description and claims taken in conjunction with the accompanying drawings.

DESCRIPTION OF EMBODIMENTS

A preferred embodiment of an inkjet printer according to the invention is described below with reference to the accompanying figures.

General Configuration of an Inkjet Printer

Figure 1:
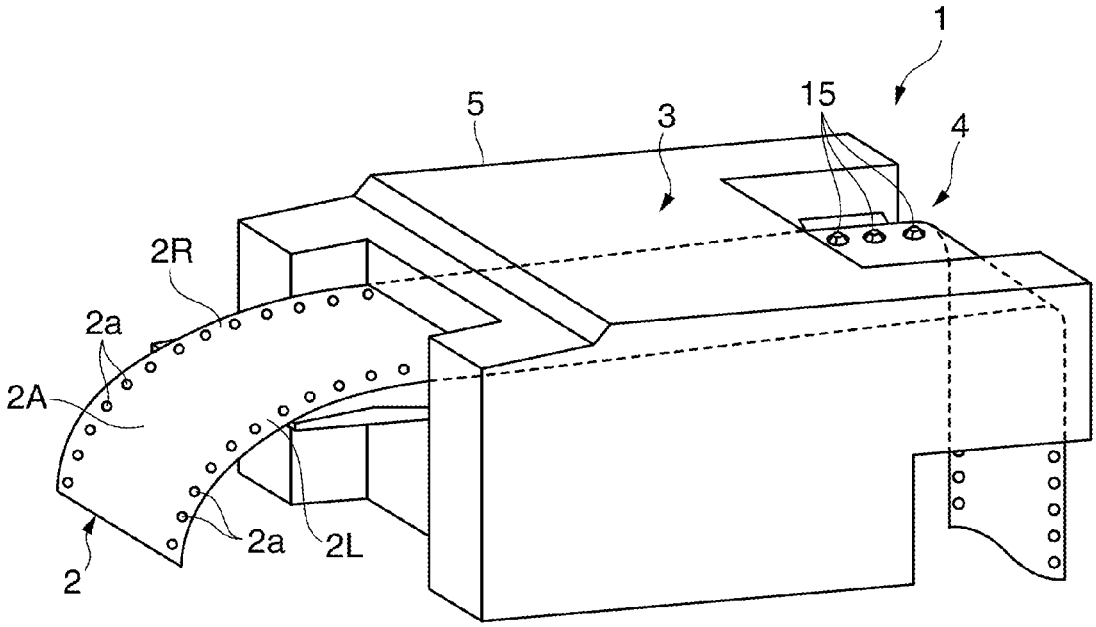
FIG. 1 is an external oblique view an inkjet printer according to the invention.
Figure 2:
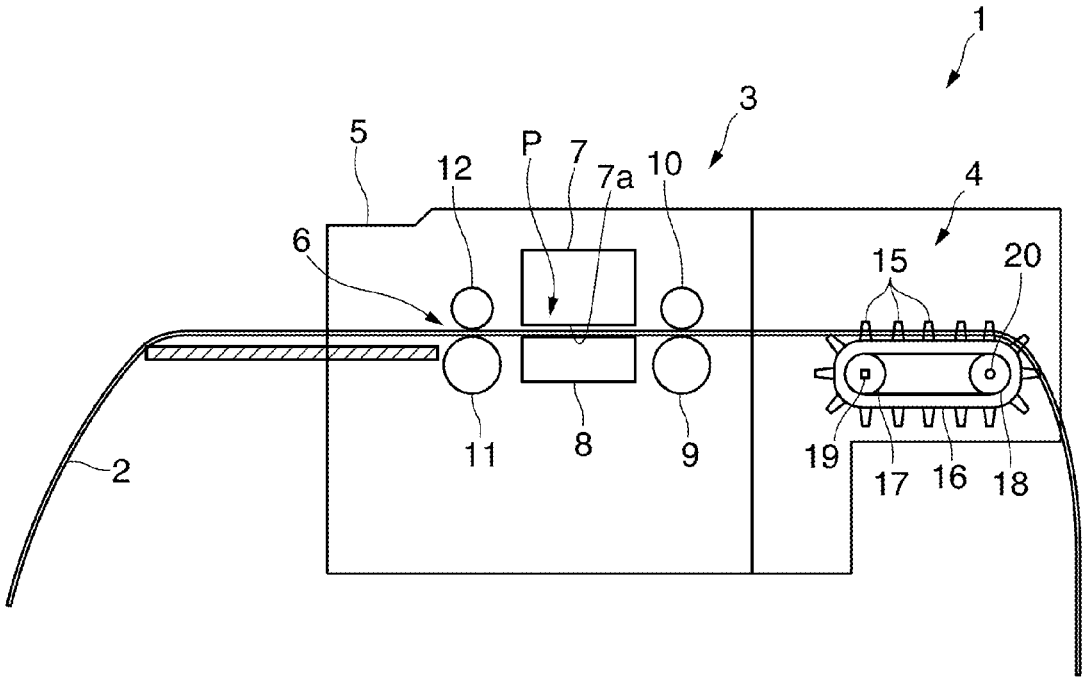
FIG. 2 is a vertical section view showing main parts of the inkjet printer shown in FIG. 1.
Figure 3:
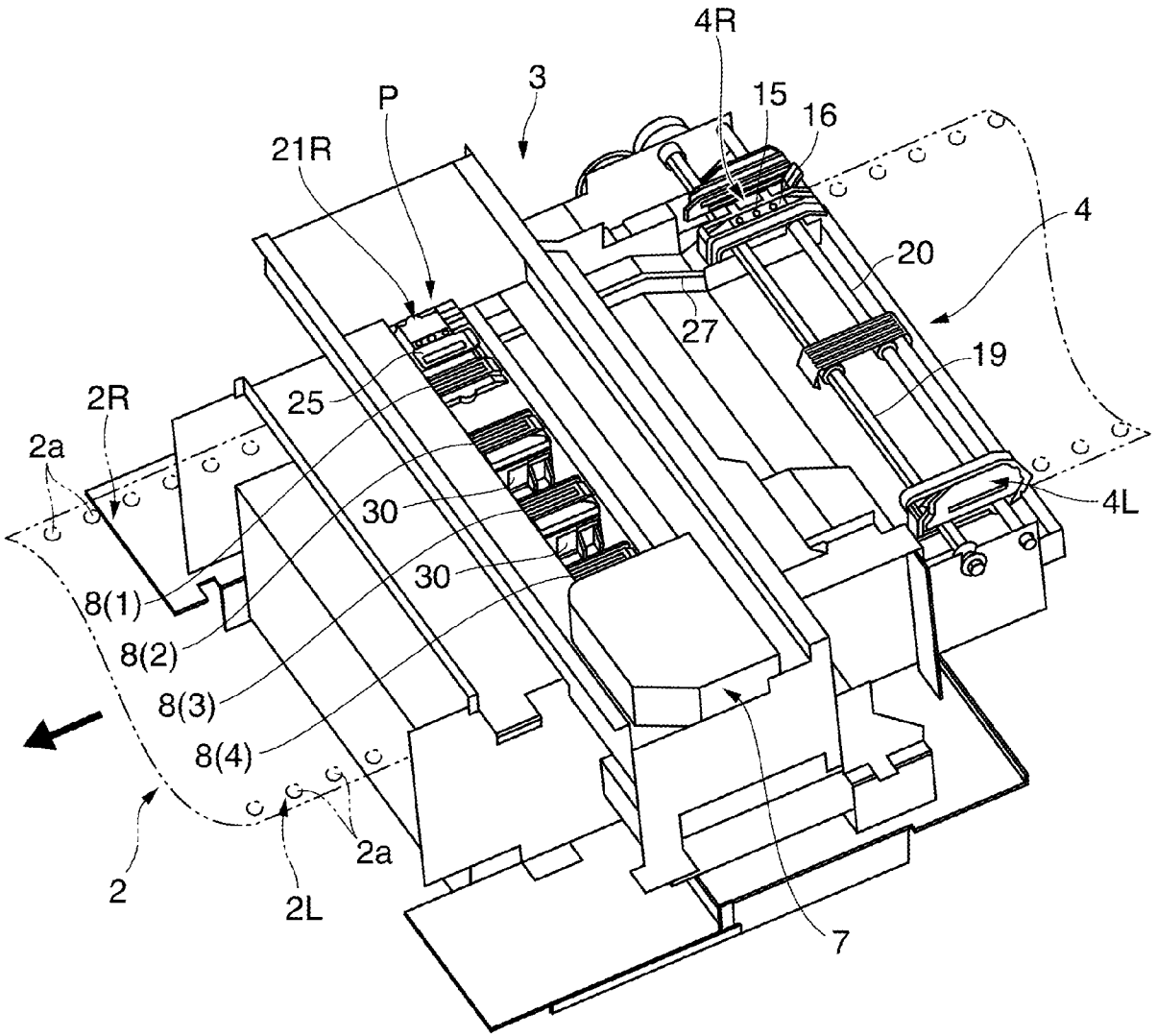
FIG. 3 is an oblique view of the inkjet printer shown in FIG. 1 with the cover removed.
Figure 4:
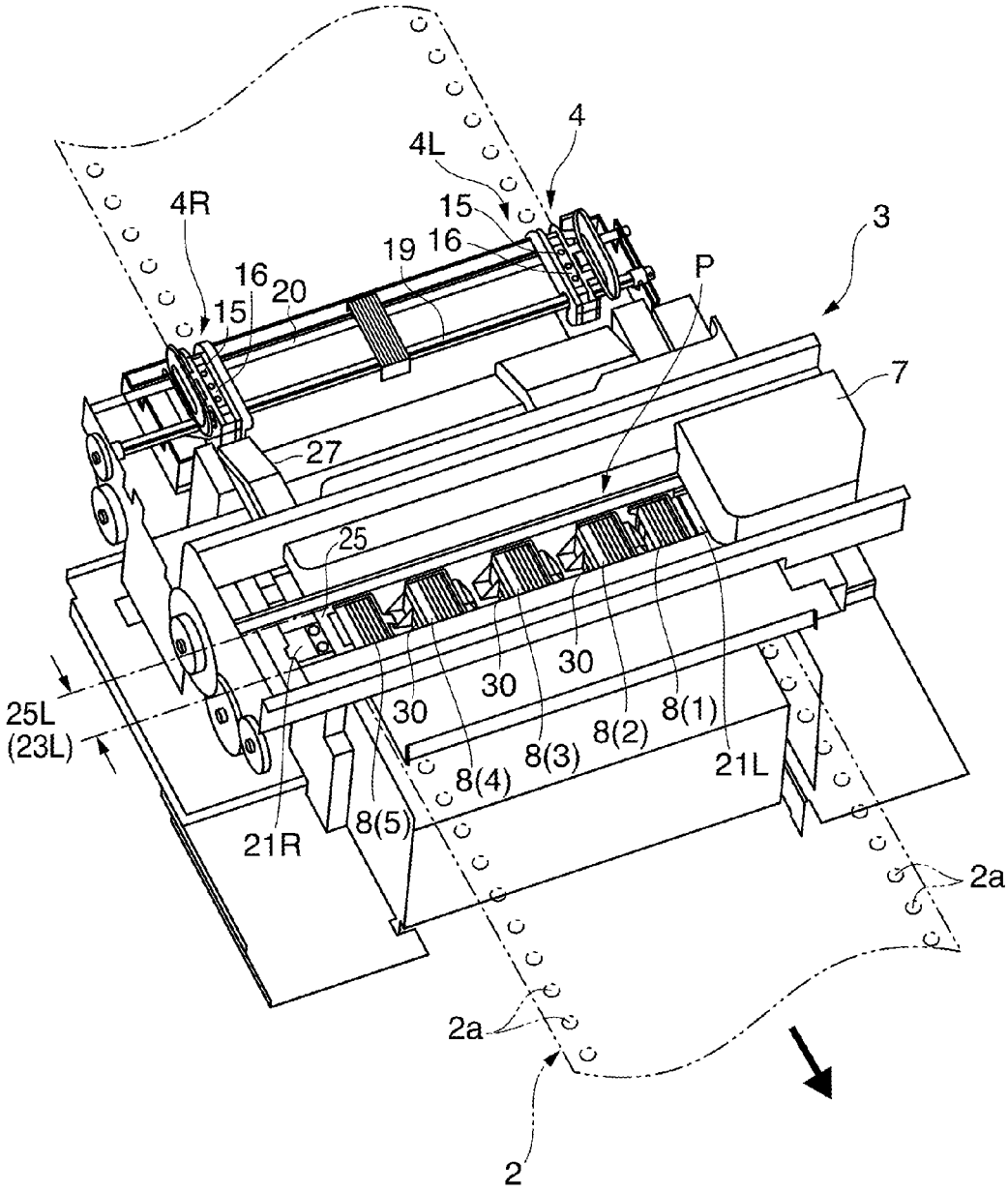
FIG. 4 is an oblique view of the inkjet printer shown in FIG. 1 with the cover removed.

FIG. 1 is an external oblique view an inkjet printer according to this embodiment of the invention, and FIG. 2 is a vertical section view showing main parts of the inkjet printer 1. FIG. 3 is an oblique view from the front of the inkjet printer with the printer case removed, and FIG. 4 is an oblique view from the back of the inkjet printer with the printer case removed.

The inkjet printer 1 according to this embodiment of the invention is a printer that prints on tractor feed paper 2. Sprocket holes 2*a* used for conveying the paper are formed at a specific interval along the length of both widthwise edges of the tractor feed paper 2. The inkjet printer 1 has a printer unit 3, a tractor unit 4 disposed at the back end of the printer unit 3, and a printer case 5 that covers the printer unit 3 and tractor unit 4. The tractor feed paper 2 is conveyed horizontally through the paper conveyance path 6 from the back of the printer into the printer unit 3 by the tractor unit 4 and printed on, and the printed tractor feed paper 2 is then discharged to the printer front from the printer unit 3.

The inkjet printer 1 has a straight paper conveyance path 6 that extends horizontally from the tractor unit 4 through the inside of the printer unit 3 to the printer front. An inkjet head 7 is disposed to a part of the paper conveyance path 6 inside the printer unit 3. The inkjet head 7 has a nozzle face 7*a* in which a plurality of nozzles (not shown in the figure) that discharge ink droplets are formed. The inkjet head 7 is disposed to a position above the paper conveyance path 6 so that the nozzle face 7*a* faces down.

The inkjet head 7 is, for example, a serial printhead that prints on the printing surface 2A of the tractor feed paper 2 while travelling bidirectionally widthwise to the conveyance path. As known from the literature, the inkjet head 7 is mounted on a carriage, and the carriage moves bidirectionally widthwise to the conveyance path (that is, widthwise to the paper) by means of a carriage drive mechanism including a drive motor, pulleys, and belt. A line inkjet head with a length compatible with the conveyance path width can obviously also be used as the inkjet head 7.

As will be understood from FIG. 3 and FIG. 4, a plurality of platens 8(1) to 8(5) are arranged in line transversely to the conveyance path at a position opposite the nozzle face 7*a* of the inkjet head 7 with the paper conveyance path 6 therebetween. The surfaces of the platens 8(1) to 8(5) are all at the same height, and the platen surface that determines the printing position P of the inkjet head 7 on the paper conveyance path 6 is formed by these surfaces. In this embodiment of the invention the five platens 8(1) to 8(5) determine the platen surface that guides the tractor feed paper 2 passed the printing position P, but the number of platens 8(1) to 8(5) is not so limited and can obviously be other than five.

As shown in FIG. 2, a paper feed roller 9 for conveying the tractor feed paper 2 toward the printing position P is disposed to the part of the conveyance path between the tractor unit 4 and the printing position P of the paper conveyance path 6. A pressure roller 10 for pressing the tractor feed paper 2 to the paper feed roller 9 is pressed from above with specific pressure to the paper feed roller 9.

A discharge roller 11 for discharging the tractor feed paper 2 after printing is completed is disposed at a position closer to the front of the printer (a position downstream in the conveyance direction) than the printing position P of the paper conveyance path 6. A pressure roller 12 for pressing the tractor feed paper 2 to the discharge roller 11 is pressed from above with specific pressure to the discharge roller 11.

The tractor unit 4 has a pair of left and right tractors 4L, 4R disposed on opposite sides of the width of the paper conveyance path 6. Each tractor 4L, 4R has tractor pins (engaging members) 15 that are inserted to the left and right sprocket holes 2*a* of the tractor feed paper 2. The tractor pins 15 are formed at a regular interval along the outside of the tractor belt 16. The tractor belt 16 is mounted on a drive pulley 17 and follower pulley 18 disposed front and back in the conveyance direction, forming an oval endless track.

The gap between the pair of tractors 4L, 4R widthwise to the conveyance path can be adjusted so that different widths of tractor feed paper 2 can be conveyed. In this embodiment of the invention one tractor is stationary and the other tractor can be moved widthwise to the conveyance path for adjustment to the width of the tractor feed paper 2 to be conveyed. The right tractor 4R is the adjustable tractor that can move widthwise to the conveyance path, and the left tractor 4L is the stationary tractor that does not move. Both tractors 4L, 4R could also be adjustable.

Both tractors 4L, 4R are identically constructed. A through-hole that is rectangular in section is formed passing through the center of the drive pulley 17 widthwise to the conveyance path, and a drive shaft 19 that is rotationally driven by power from a drive motor not shown is inserted to this through-hole. The drive shaft 19 extends horizontally widthwise to the conveyance path and is supported freely rotatably on the frame (not shown in the figure) of the inkjet printer 1. The drive motor (not shown) is connected to one end of the drive shaft 19 through a power transfer mechanism including a belt and pulleys. The drive shaft 19 is a rectangular shaft, and when the drive shaft 19 turns the drive pulley 17 rotates with the drive shaft 19.

A round guide hole is formed passing widthwise to the conveyance path through the center of the follower pulley 18 of the tractors 4L, 4R. A cylindrical guide shaft 20 that guides the adjustable tractor 4R widthwise to the conveyance path is inserted to this guide hole. The guide shaft 20 extends horizontally widthwise to the conveyance path, and is fastened to the frame (not shown in the figure) of the inkjet printer 1. The follower pulley 18 can rotate on the guide shaft 20.

The follower pulley 18 of the right tractor 4R can therefore move transversely to the conveyance path along the guide shaft 20. The drive pulley 17 can also move transversely to the conveyance path on the drive shaft 19.

To convey the tractor feed paper 2 by means of this tractor unit 4 having a pair of tractors 4L, 4R, the tractor feed paper 2 is set so that the sprocket holes 2*a* on both sides of the tractor feed paper 2 are mounted on the tractor pins 15 of the respective tractors 4L, 4R. The drive pulley 17 is then turned to rotate the tractor belt 16. The tractor pins 15 circulate around the endless track of the tractor belt 16, engaging and disengaging the sprocket holes 2*a* of the tractor feed paper 2, and thereby convey the tractor feed paper 2.

Paper Edge Cover and Tractor

Figure 5A:
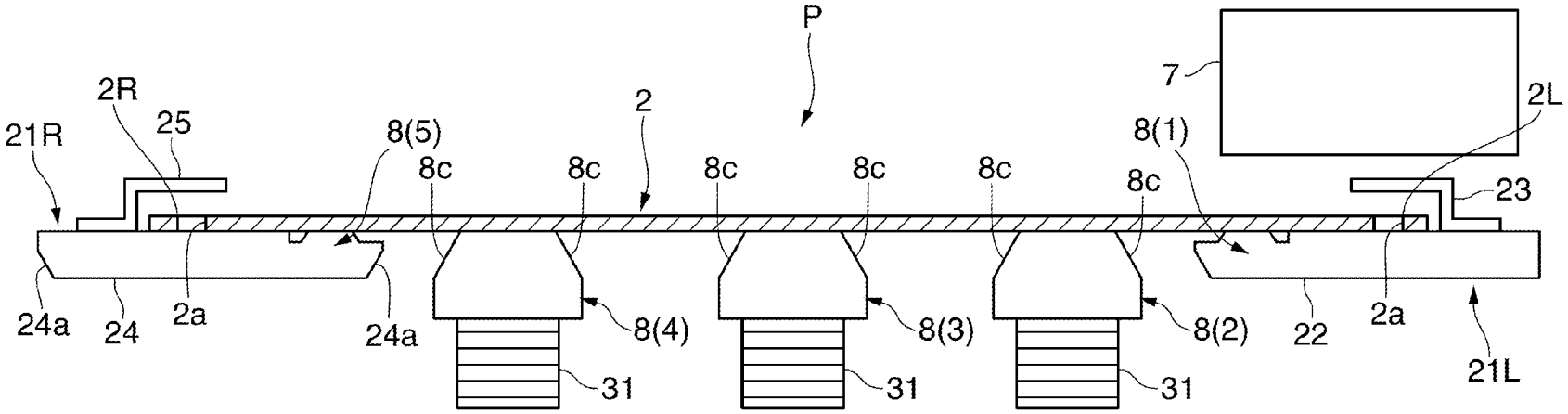
FIG. 5A describes the paper edge covers and platen disposed at the printing position of the inkjet printer shown in FIG. 1.
Figure 5B:
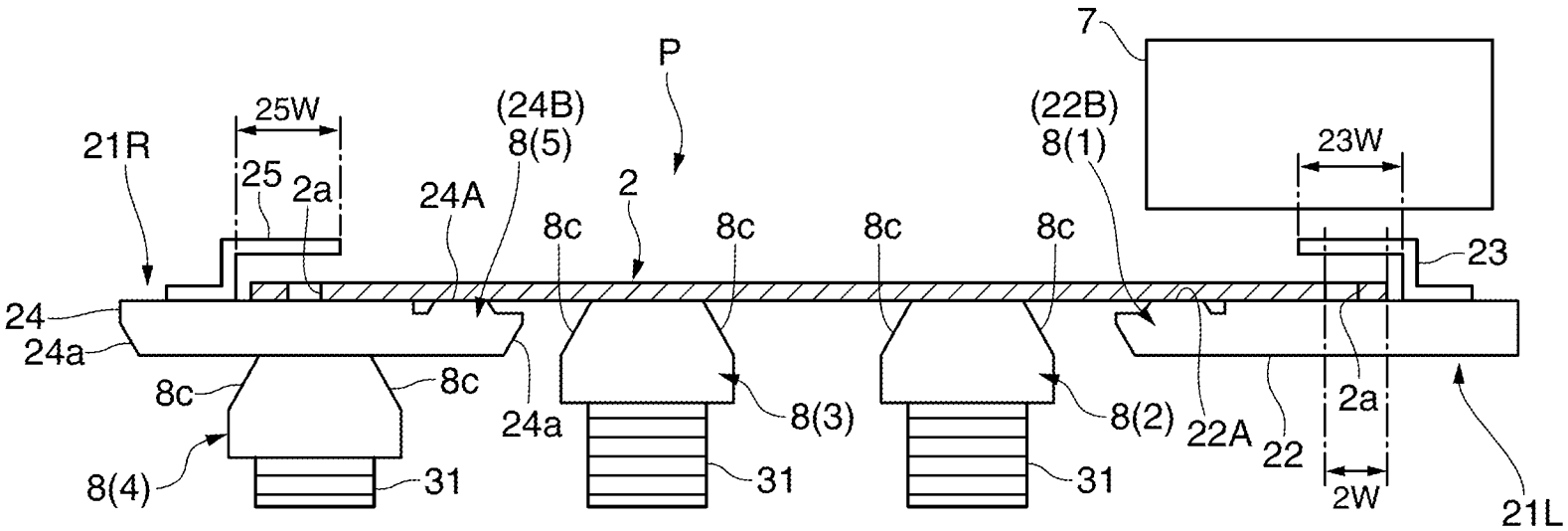
FIG. 5B shows the state after moving a movable platen in FIG. 5A.
Figure 6A:
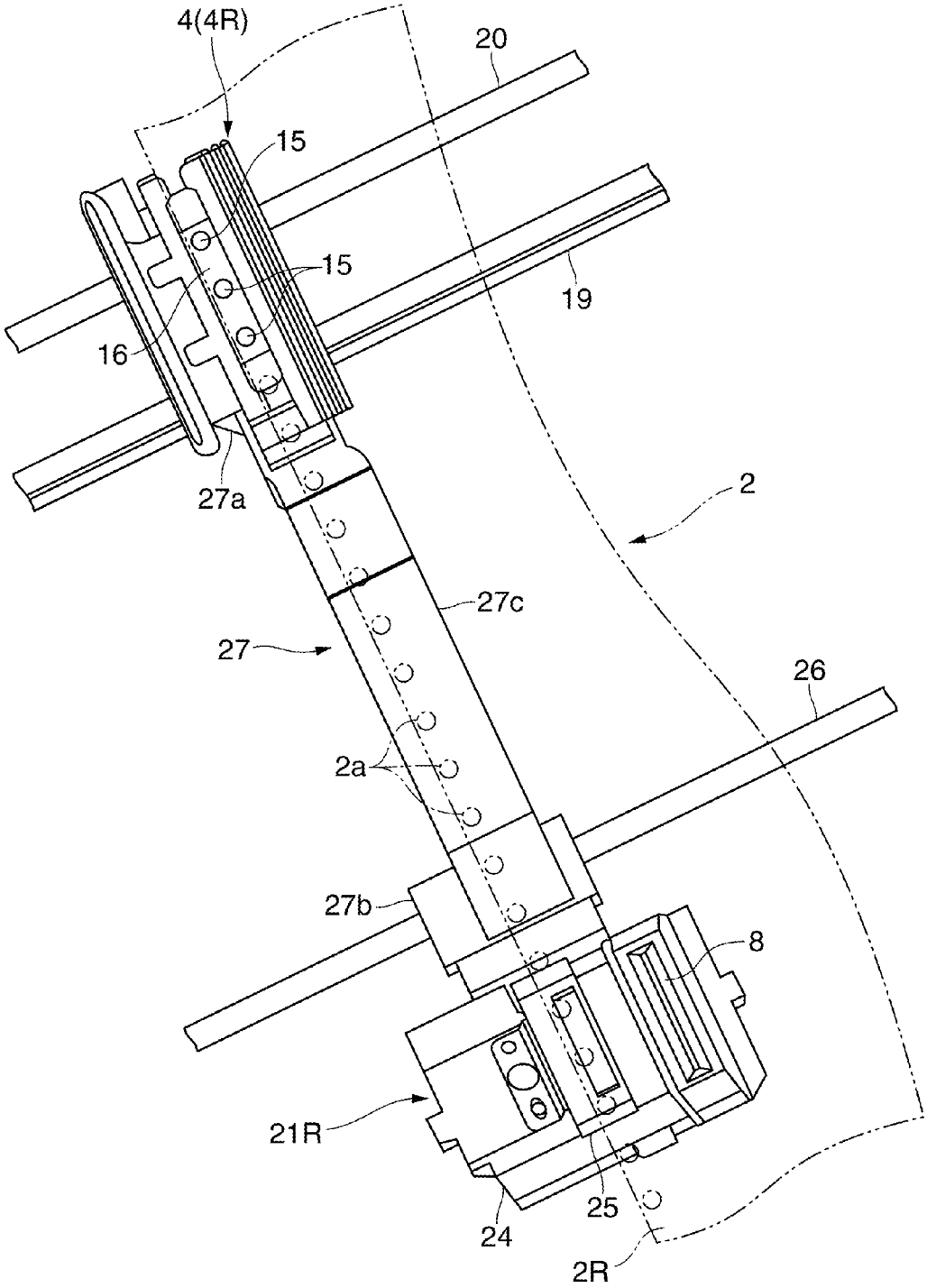
FIG. 6A is an oblique view of the movable cover, movable tractor, and connecting member from the front.
Figure 6B:
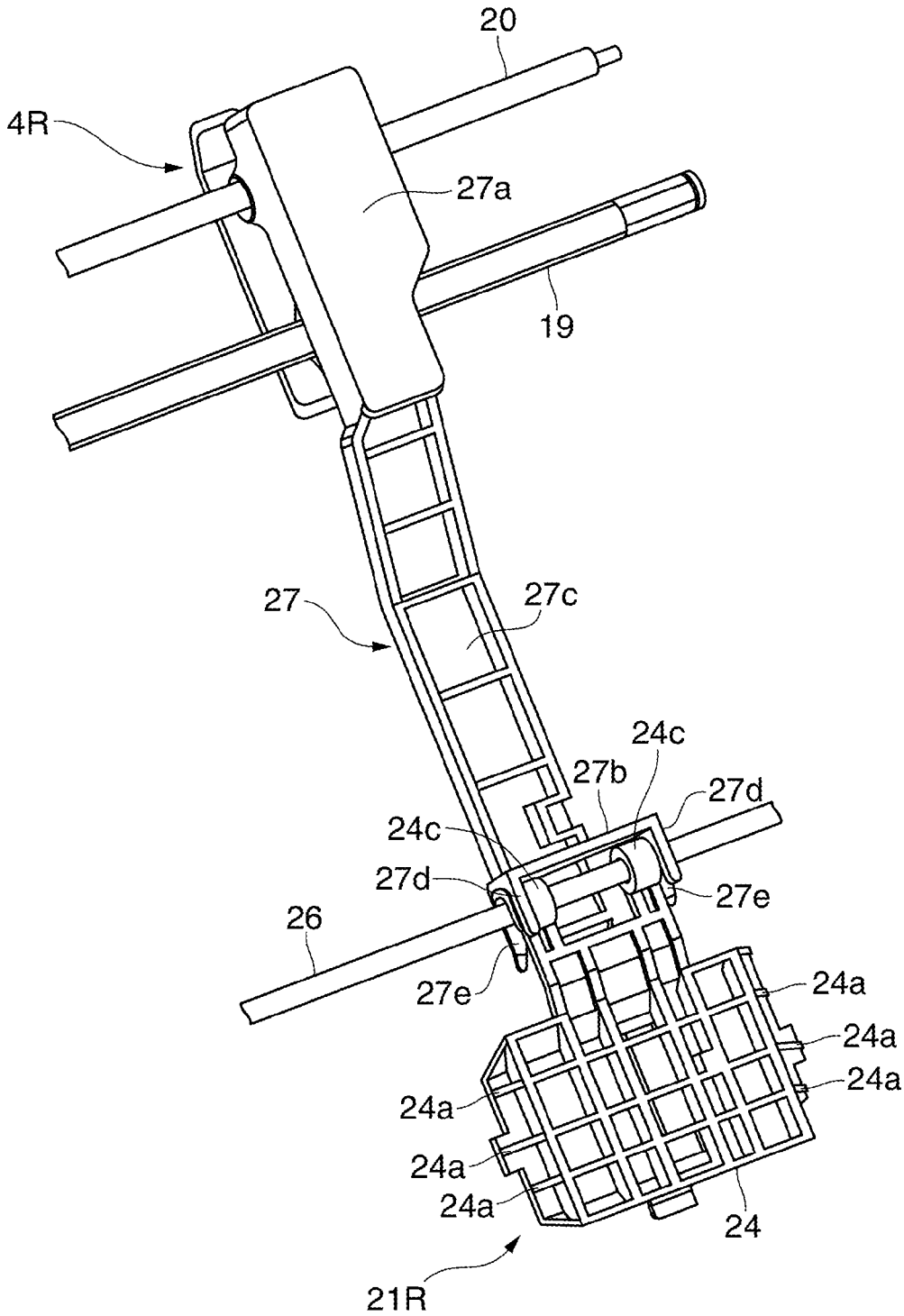
FIG. 6B is an oblique view of the movable cover, movable tractor, and connecting member from the back.

FIG. 5A and FIG. 5B describe the configuration of the inkjet printer 1 at the printing position P as seen in the paper conveyance direction. FIG. 6A is an oblique view of the movable cover and tractor from the front, and FIG. 6B is an oblique view of the same from the back.

As shown in these figures, the inkjet printer 1 has a left and right pair of paper edge covers 21L, 21R for covering and hiding both side edges of the tractor feed paper 2 where the sprocket holes 2*a* are formed from the nozzle face 7*a* of the inkjet head 7 at the printing position P. The paper edge covers 21L, 21R are disposed along the edges of the paper conveyance path 6 on opposite sides of the conveyance path width.

The left and right paper edge covers 21L, 21R can adjust the gap therebetween widthwise to the conveyance path, and can thereby cover and hide the edges of both sides where the sprocket holes 2*a* are formed on different widths of tractor feed paper 2. In this embodiment of the invention the paper edge cover 21R on the same side as the adjustable tractor 4R is an adjustable cover that can move transversely to the conveyance path, and the paper edge cover 21L on the opposite side is a stationary cover whose position is fixed widthwise to the conveyance path.

As shown in FIG. 5A and FIG. 5B, the stationary paper edge cover 21L has a paper support member 22 for supporting the edge portion 2L of the tractor feed paper 2 width from below. A cover member 23 for covering and hiding the edge portion 2L of the tractor feed paper 2 where the sprocket holes 2*a* are formed from the nozzle face 7*a* of the inkjet head 7 positioned thereabove is fastened to the top of the paper support member 22 outside the width of the conveyance path. The cover member 23 is formed by bending a thin steel plate into a specific shape, for example. The width 23W of the cover member 23 (the dimension widthwise to the conveyance path) is set to a size that can completely cover the sprocket holes 2*a* of the tractor feed paper 2. More specifically, the width 23W is greater than the width 2W from the edge of the tractor feed paper 2 to the inside edge of the sprocket holes 2*a*.

A platen portion 22B with a platen surface 22A for guiding the part of the tractor feed paper 2 passing the printing position P is formed in unison with the paper support member 22 at a position inside the width of the conveyance path. In this embodiment of the invention this platen portion 22B functions as the platen 8(1) disposed at the left side of the printing position P in the paper conveyance direction.

Note that the length 23L of the cover member 23 in the paper conveyance direction is substantially the same as the length of the platens 8(1) to 8(5) in the paper conveyance direction. The cover member 23 is positioned opposite the nozzle face 7*a* in the paper conveyance direction, and its length 23L is preferably at least as long as the length of the nozzle face 7*a* in the paper conveyance direction. The length can, of course, also be greater.

The adjustable paper edge cover 21R disposed on the opposite side of the conveyance path width is constructed left and right symmetrically to the paper edge cover 21L, and includes a paper support member 24 for supporting the edge of the tractor feed paper 2, and a cover member 25 for covering and hiding the edge portion 2R where the sprocket holes 2*a* are formed in the tractor feed paper 2. The cover member 25 is made by bending a thin steel plate to the specified shape, for example. The width 25W of the cover member 25 (the dimension widthwise to the conveyance path) is set to a size that can completely cover the sprocket holes 2*a* of the tractor feed paper 2. More specifically, the width 25W is greater than the width 2W from the edge of the tractor feed paper 2 to the inside edge of the sprocket holes 2*a*. The length 25L of the cover member 25 in the paper conveyance direction is also substantially the same as the length of the nozzle face 7*a*.

A platen portion 24B with a platen surface 24A for guiding the part of the tractor feed paper 2 passing the printing position P is also formed in unison with the paper support member 24 at a position inside the width of the conveyance path. In this embodiment of the invention this platen portion 24B functions as the platen 8(5) disposed at the right side of the printing position P in the paper conveyance direction. Therefore, of the five platens 8(1) to 8(5), the end platens 8(1) and 8(5) are rendered by the platen portions 22B and 24B formed in unison with the paper edge covers 21L, 21R, and the three platens 8(2) to 8(4) therebetween are identically configured independent platens.

Chamfered faces 24*a* that slope down narrowing the width of the paper support member 24 widthwise to the conveyance path are formed on both sides of the paper support member 24 widthwise to the conveyance path. As described below, when paper edge cover 21R moves to the inside widthwise to the conveyance path, the inside chamfered face 24*a* contacts the adjacent platen 8(4). The chamfered face 24*a* then functions as a guide enabling the platen 8(4) to retract smoothly from the guide position where it guides the part of the tractor feed paper 2 passing the printing position P so that the paper edge cover 21R can be moved smoothly.

As shown in FIG. 6B, two protruding parts 24*c* that project toward the back are formed to the back end of the paper support member 24 in the paper feed direction. The two protruding parts 24*c* are formed with a specific gap therebetween transversely to the conveyance path. Round guide holes are formed passing through the protruding parts 24*c* widthwise to the conveyance path. A round guide shaft 26 that guides the adjustable paper edge cover 21R widthwise to the conveyance path passes through these guide holes. The guide shaft 26 extends horizontally widthwise to the conveyance path, and is fastened to the frame not shown of the inkjet printer 1.

The adjustable tractor 4R and adjustable paper edge cover 21R disposed to the same side widthwise to the conveyance path are connected by a connecting member 27. The tractor 4R and paper edge cover 21R therefore move together transversely to the conveyance path. The connecting member 27 includes a tractor mount 27*a* to which the tractor 4R is mounted, and an engaging part 27*b* that engages the paper support member 24 of the paper edge cover 21R. The tractor mount 27*a* and engaging part 27*b* are connected by a connecting part 27*c*.

A pair of stops 27*d* are disposed to the engaging part 27*b* of the connecting member, and these stops 27*d* are disposed on opposite sides of the two protruding parts 24*c* of the paper support member 24 of the paper edge cover 21R widthwise to the conveyance path. A channel 27*e* that is U-shaped in section when seen from a widthwise side of the conveyance path and opens to the paper edge cover 21R side is formed in each of the stops 27*d*. The guide shaft 26 is fit into these channels 27*e*. The stops 27*d* of the connecting member 27 can therefore move in the paper conveyance direction relative to the guide shaft 26.

When the width of the tractor feed paper 2 used in the inkjet printer 1 changes, the user holds a particular part of the tractor 4R and moves the tractor 4R transversely to the conveyance path. When the tractor 4R moves widthwise to the conveyance path, the surface of the connecting member 27 stops 27*d* widthwise to the conveyance path contacts the outside of the protruding parts 24*c* widthwise to the conveyance path, and the paper edge cover 21R also moves widthwise to the conveyance path.

The connecting member 27 thus engages the guide shaft 26 of the paper edge cover 21R with some play. The connecting member 27 can therefore be prevented from twisting and becoming stuck and unable to move with the inside surface of the channel 27*e* pushed against the outside of the guide shaft 26 when the adjustable tractor 4R is moved. The paper edge cover 21R can therefore be moved smoothly in conjunction with the tractor 4R widthwise to the conveyance path.

Platen Structure

Figure 7A:
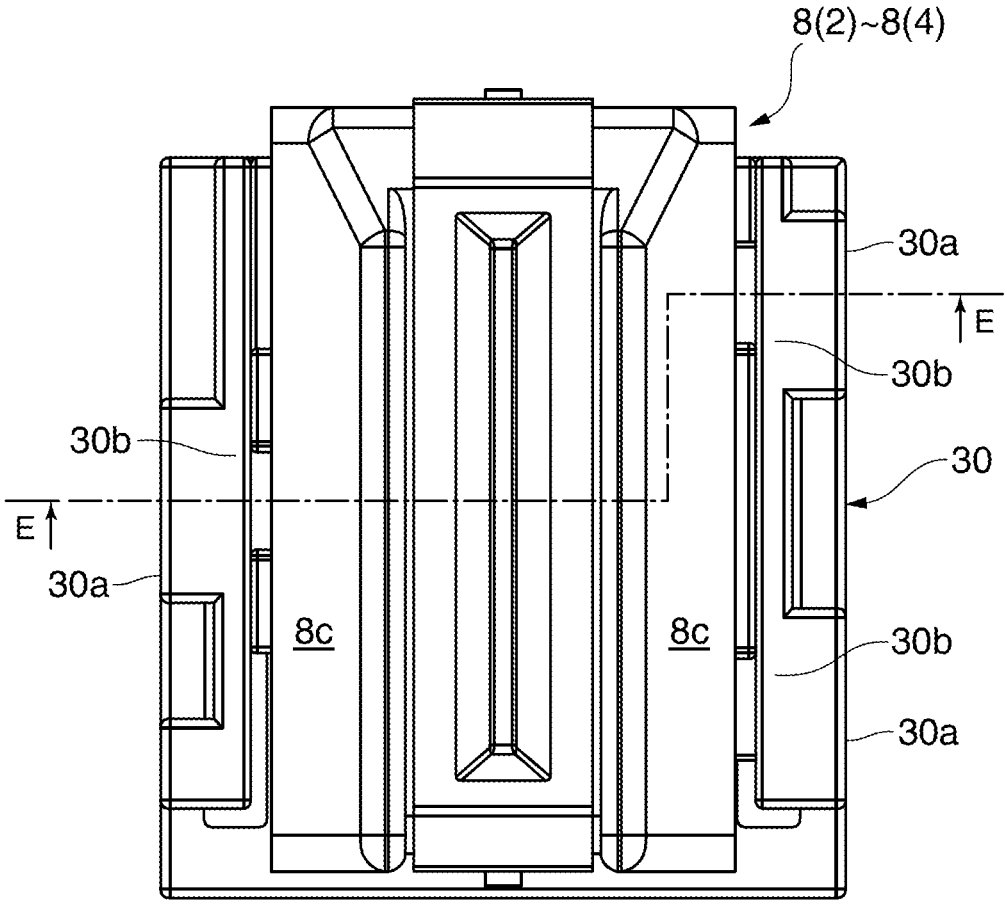
FIG. 7A is a plan view of the platen.
Figure 7B:
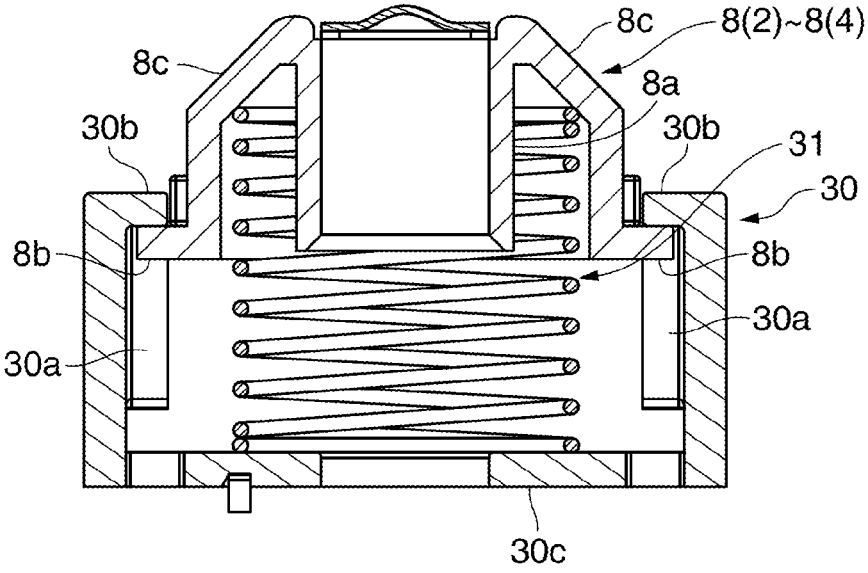
FIG. 7B is a section view of the platen through line E-E in FIG. 7A.

FIG. 7A is a plan view showing the structure of the three platens 8(2) to 8(4) disposed between the left and right paper edge covers 21L, 21R, and FIG. 7B is a section view through line E-E in FIG. 7A. These three platens 8(2) to 8(4) have the same construction, and are supported movably in the direction to and away from (that is, vertically) the nozzle face 7*a* of the inkjet head 7 by means of respective support members 30 disposed with a specific gap therebetween transversely to the conveyance path. A compression spring 31 is mounted as an urging member between each support member 30 and corresponding platen 8(2) to 8(4), and the platens 8(2) to 8(4) are urged to the nozzle face side and held at the guide position guiding the portion of the tractor feed paper 2 passing the printing position P by the force of the compression spring 31. Therefore, when the platens 8(2) to 8(4) are pushed down against the springs, the platens 8(2) to 8(4) can retract from the guide position to a position separated from the nozzle face 7*a*. Because the three platens 8(2) to 8(4) are thus platens that can move, these three platens 8(2) to 8(4) are also called movable platens.

As shown in FIG. 7B, the movable platens 8(2) to 8(4) each have an internal cylindrical spring insertion unit 8*a* that is inserted to the top of the compression spring 31. A flange 8*b* that projects to the outside left and right is formed at the bottom end of each platen 8(2) to 8(4). Sloped faces 8*c* that incline upward in the direction narrowing the width of the platens 8(2) to 8(4) widthwise to the conveyance path are formed at the top ends of the platens 8(2) to 8(4).

The support member 30 is a box shape with an open top. The support member 30 is affixed to the frame not shown of the inkjet printer 1. A guide member 30*a* that guides the flange 8*b* vertically is formed to the outside of the support member 30 widthwise to the conveyance path. The guide member 30*a* is shaped as a channel engaged by the flange 8*b*, and limits movement of the flange 8*b* in the conveyance direction and widthwise to the conveyance path. A stop 30*b* that contacts the top of the flange 8*b* and limits upward movement of the movable platen 8 is formed to the top end of the guide member 30*a*.

The bottom end of the compression spring 31 contacts the top of the bottom 30*c* of the support member 30. The top end of the compression spring 31 contacts the inside top part of the platen 8(2) to 8(4). The spring insertion unit 8*a* of the platen 8(2) to 8(4) is inserted to the top of the compression spring 31.

When the adjustable paper edge cover 21R moves, the platens 8(2) to 8(4) thus configured are moved by the paper edge cover 21R. Referring to FIG. 5, the paper edge cover 21R is moved widthwise to the conveyance path when the width of the tractor feed paper 2 used by the inkjet printer 1 changes. For example, referring to FIG. 5A, when the paper edge cover 21R moves to the inside widthwise to the conveyance path, the chamfered face 24*a* of the paper edge cover 21R contacts the sloped face 8*c* of the adjacent platen 8(4). As shown in FIG. 5B, the platen 8(4) is pushed down against the urging force of the compression spring 31, retracts in the direction separating from the nozzle face 7*a* from the guide position that guides the tractor feed paper 2 passing the printing position P, and slides under the paper support member 24 of the paper edge cover 21R.

When the paper edge cover 21R then returns to the outside widthwise to the conveyance path, the retracted platen 8(4) rises to the position where the flange 8*b* and stop 30*b* touch as shown in FIG. 5A due to the urging force of the compression spring 31. The platen 8(4) can thus move in the direction retracting from the path of paper edge cover 21R movement from the guide position that guides the tractor feed paper 2 passed the printing position P so that the paper edge cover 21R can move widthwise to the conveyance path. The other two platens 8(3) to 8(4) can move in the same way.

As described above, the inkjet printer 1 has paper edge covers 21L, 21R at the printing position P to cover and hide the edge portions 2L, 2R where the sprocket holes 2*a* are formed on both sides of the tractor feed paper 2 from the nozzle face 7*a* of the inkjet head 7. As a result, foreign matter and particularly paper dust from the sprocket holes 2*a* is prevented by the paper edge covers 21L, 21R from rising up to the nozzle face 7*a* of the inkjet head 7. The inkjet head 7 can thus be protected from poor ink droplet discharge or being unable to discharge ink droplets as a result of foreign matter and particularly paper dust from the sprocket holes 2*a* sticking to the nozzle face 7*a*.

The paper edge cover 21R is a movable cover that can move widthwise to the conveyance path, and the three inside movable platens 8(2) to 8(4) can retract to a position separated from the path of paper edge cover 21R movement so that the paper edge cover 21R can move widthwise to the conveyance path. As a result, even when the platens 8(2) to 8(4) are at the printing position P, the paper edge cover 21R can be moved widthwise to the conveyance path (widthwise to the printer) and set to the width of the tractor feed paper 2 used in the inkjet printer 1. More specifically, even when the width of the tractor feed paper 2 being used changes, the paper edge covers 21L, 21R can reliably cover and hide both edge portions 2L, 2R of the tractor feed paper 2 where the sprocket holes 2*a* are formed. Therefore, paper dust from the sprocket holes 2*a* can be prevented from clinging to the nozzle face 7*a* of the inkjet head 7 even when the width of the tractor feed paper 2 being used is changed, and clogging and other inkjet head 7 nozzle problems caused by paper dust, for example, can be prevented.

The movable platens 8(2) to 8(4) are also held movably by the support member 30 through the intervening compression spring 31. As a result, the movable platen 8 can be moved by means of a relatively simple configuration so that it does not interfere with movement of the paper edge cover 21R widthwise to the conveyance path. In addition, because a spring insertion unit 8*a* that is inserted to the compression spring 31 is formed on each platen 8(2) to 8(4), the relative positions of the platens 8(2) to 8(4) and the compression springs 31 can be prevented from shifting in the direction perpendicular to the direction of movable platen 8(2) to 8(4) movement.

When the movable platen 8(2) to 8(4) contacts the paper edge cover 21R moving widthwise to the conveyance path, is pushed down against the urging force of the compression spring 31, retracts from the path of the paper edge cover 21R, and the paper edge cover 21R finishes passing, the platen returns to the position where the flange 8*b* contacts stop 30*b* due to the urging force of the compression spring 31. More specifically, the movable platens 8(2) to 8(4) can be moved by the paper edge cover 21R and compression spring 31. A complicated configuration for moving the movable platens 8(2) to 8(4) is therefore not needed, and the configuration of the inkjet printer 1 can be simplified. In addition, a chamfered face 24*a* is formed on the paper edge cover 21R, and a sloped face 8*c* is formed at the part of the movable platens 8(2) to 8(4) that contacts the chamfered face 24*a*. Therefore, when the paper edge cover 21R contacts the movable platen 8(2) to 8(4), the movable platen 8(2) to 8(4) can be made to retract smoothly.

Other Embodiments

The embodiment described above is one embodiment of the invention and can be varied in many ways without departing from the scope of the accompanying claims as described below.

The movable platens 8(2) to 8(4) described above can be moved away from the nozzle face 7*a* so that the paper edge cover 21R can move widthwise to the conveyance path. Alternatively, the platens 8(2) to 8(4) could be moved widthwise to the conveyance path.

Figure 8A:
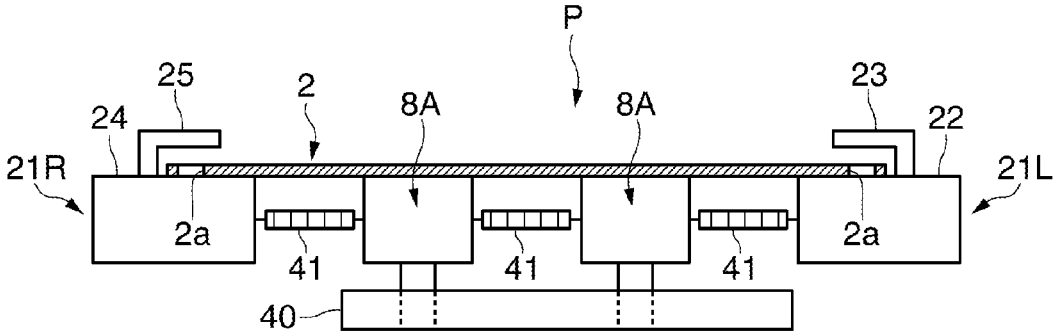
FIG. 8A describes an example of a movable platen.
Figure 8B:
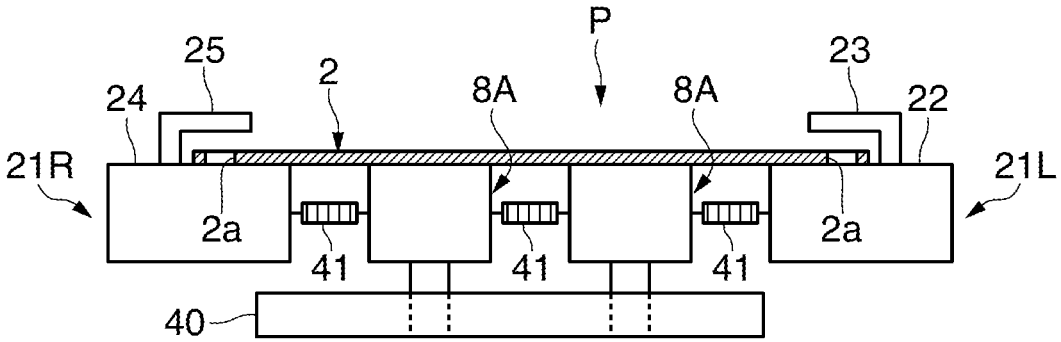
FIG. 8B shows the state after moving the movable platen in FIG. 8A.
Figure 9A:
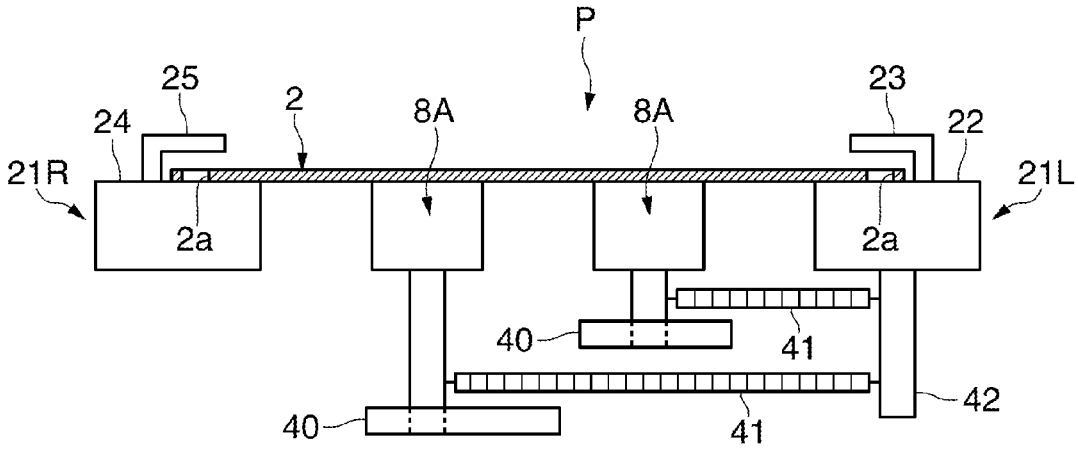
FIG. 9A describes an example of a movable platen.
Figure 9B:
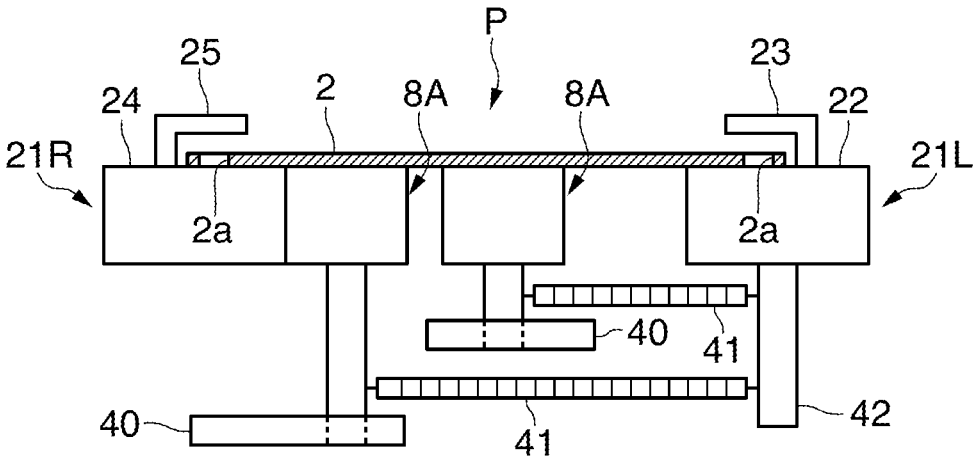
FIG. 9B shows the state after moving the movable platen in FIG. 9A.

For example, as shown in FIG. 8A and FIG. 8B, and FIG. 9A and FIG. 9B, the movable platen 8A may be supported movably widthwise to the conveyance path by a support member 40, and could be urged to one side of the conveyance path width by a compression spring 41. In this case, as shown in FIG. 8A and FIG. 8B, a compression spring 41 can be disposed between adjacent movable platens 8A and between the paper edge covers 21L, 21R and the respectively adjacent movable platens 8A. Further alternatively, a compression spring 41 may be disposed between the frame 42 of the inkjet printer 1 and each movable platen 8A as shown in FIG. 9A and FIG. 9B.

When a compression spring 41 is disposed between adjacent movable platens 8A and between the paper edge cover 21R and a movable platen 8A, when the paper edge cover 21R moves inside widthwise to the conveyance path from the position shown in FIG. 8A, the movable platen 8A moves to the inside widthwise to the conveyance path in resistance to the urging force of the compression spring 41 as shown in FIG. 8B. At this time, the paper edge cover 21R and plural movable platens 8A can be moved to the inside widthwise to the conveyance path while maintaining the same gap between adjacent movable platens 8A and between the paper edge cover 21R and movable platen 8A. In addition, when a compression spring 41 is between the frame 42 and a movable platen 8A, the movable platen 8A is pushed and moves in the same direction against the force of the compression spring 41 when the paper edge cover 21R moves widthwise to the conveyance path and contacts the movable platen 8A as shown in FIG. 9B.

A tension spring can also be used instead of a compression spring, and in this case each movable platen 8A is disposed so that it is pulled to the movable paper edge cover 21R side in FIG. 9A and FIG. 9B.

Figure 10A:
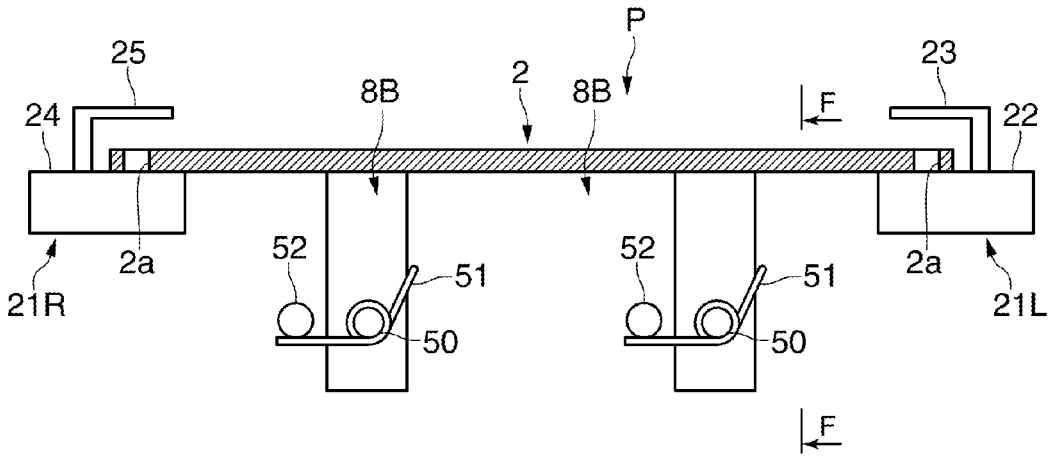
FIG. 10A describes an example of a movable platen.
Figure 10B:
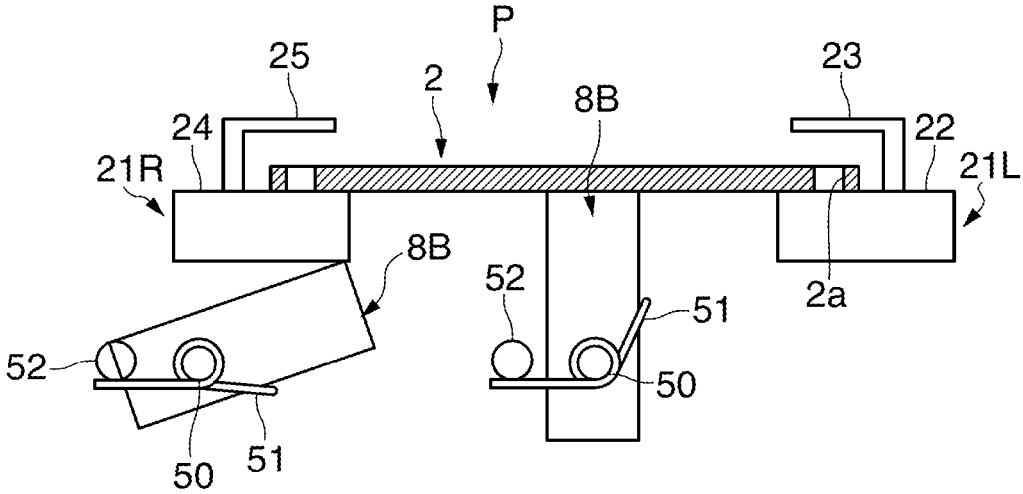
FIG. 10B shows the state after moving the movable platen in FIG. 10A.
Figure 10C:
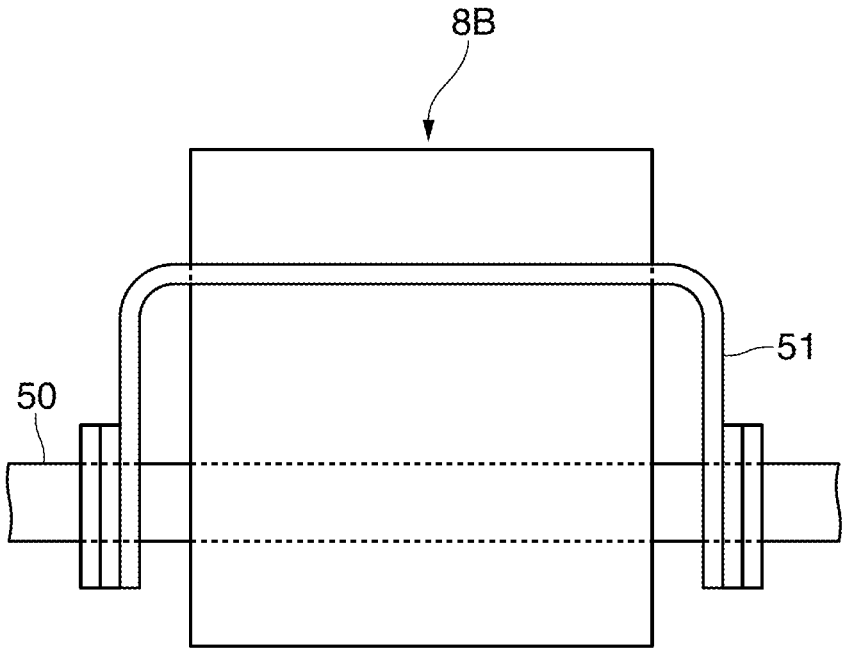
FIG. 10C describes the movable platen when seen from the direction of arrow F in FIG. 10A.

Further alternatively, as shown in FIG. 10A to FIG. 10C, a movable platen 8B may be rockably disposed on a support shaft 50 so that the movable platen 8B can retract from the path of the paper edge cover 21R. In this configuration, the support shaft 50 is disposed horizontally in the conveyance direction, and the movable platen 8B is rotatably supported on the support shaft 50 and is urged counterclockwise on the support shaft 50 as seen in FIG. 10 and FIG. 10B (the direction toward the nozzle surface of the inkjet head) by a double torsion spring 51. In this case, as shown in FIG. 10B, when the paper edge cover 21R moves to the inside widthwise to the conveyance path and contacts the top of the movable platen 8B, the movable platen 8B rotates clockwise (the direction away from the nozzle surface) in FIG. 10A and FIG. 10B on the support shaft 50 in resistance to the double torsion spring 51. More specifically, the movable platen 8B retracts downward at an angle. Note that the end of the double torsion spring 51 engages a fixed pin 52. The counterclockwise range of rotation of the movable platen 8B is limited by a stop not shown in the figures.

In the embodiment described above three platens 8(2) to 8(4) not including the platens 8(1) and 8(5) formed in unison with the paper edge covers 21L, 21R are movable platens, but the invention is not so limited. For example, only the platen that is located in the range of paper edge cover 21R movement could be rendered as a movable platen. In this case, platens located outside the range of paper edge cover 21R movement are stationary platens fixed to the printer frame. In addition, because platens located outside the range of paper edge cover 21R movement do not require a moving mechanism, the configuration of the inkjet printer 1 can be simplified accordingly.

In the embodiment described above each of the platens 8(2) to 8(4) is urged by a compression spring 31, but could be urged by a tension spring, flat spring, or other spring member. In addition, the paper edge cover 21L is fixed to the printer frame, but the paper edge cover 21L could also be a movable cover. Yet further, the paper edge cover 21R and tractor 4R are connected by a connecting member 27, but could be not connected to each other and move independently. Yet further, the platens 8(1) and 8(5) are formed in unison with the paper edge covers 21L, 21R, but a paper edge cover that is not integral with a platen could obviously be used.

The embodiment described above relates to an inkjet printer that prints to tractor feed paper as the recording paper, but the invention can also be applied to inkjet printers that print to continuous paper without sprocket holes and to plain cut-sheet recording paper. By printing with both side edges of the recording paper covered and hidden from the nozzle face of the inkjet head by a pair of paper edge covers, problems with ink discharge caused by paper dust or other foreign matter from the edge parts of the recording paper clinging to the nozzle surface can be reliably prevented. The inkjet printer could be rendered without a tractor, or with an additional conveyance path for guiding cut-sheet recording paper to the printing position.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

What is claimed is:

1. An inkjet printer comprising:

an inkjet head;

a paper conveyance path for conveying recording paper past the printing position of the inkjet head;

a pair of tractors having a plurality of engaging parts that repeatedly enter and release conveyance holes while moving along an endless track in order to convey recording paper having conveyances holes formed at a specific interval along both widthwise edges parts thereof through the paper conveyance path, wherein at least one of the pair of tractors is a movable tractor;

a pair of paper edge covers disposed to the paper conveyance path on both widthwise sides thereof at a portion of the paper conveyance path of a specific length at least including the printing position, wherein at least one of the pair of paper edge covers is a movable cover, the paper edge covers being covers for covering and hiding the widthwise edge parts of the recording paper from the nozzle surface of the inkjet head as the edges pass the printing position; and a connecting member that connects the movable tractor and the movable cover.

2. The inkjet printer described in claim 1, wherein:

at least one of the pair of paper edge covers is a movable cover that can move widthwise to the conveyance path.

3. The inkjet printer described in claim 1, wherein:

the paper edge covers include a cover portion that is positioned on the inkjet head side of the paper conveyance path, and a paper support portion that is apposite the cover portion with the paper conveyance path therebetween.

4. The inkjet printer described in claim 1, wherein the width of the pair of the paper edge covers widthwise to the conveyance path is sized so that the paper edge covers can cover and hide the conveyance holes of the recording paper conveyed by the tractor.

5. The inkjet printer described in claim 4, wherein:

the movable tractor can move widthwise to the conveyance path; and the movable cover can move widthwise to the conveyance path in conjunction with the movable tractor.

6. The inkjet printer described in claim 5, further comprising:

a cover guide shaft that guides the movable cover widthwise to the conveyance path; and a tractor guide shaft that guides the tractor widthwise to the conveyance path;

wherein the connecting member engages the cover guide shaft in a manner allowing only a specific amount of movement in the paper conveyance direction of the paper conveyance path.

7. The inkjet printer described in claim 2, further comprising:

a plurality of platens arranged widthwise to the conveyance path for guiding the recording paper passed the printing position, wherein at least the platen positioned in the range of movable cover movement is a movable platen that can move when pushed by the movable cover moving widthwise to the conveyance path.

8. The inkjet printer described in claim 7, wherein:

the platen located outside the movable range of the movable cover is a stationary platen disposed to a fixed position guiding the recording paper passed the printing position.

9. The inkjet printer described in claim 7, wherein:

the paper edge covers include a cover portion that is positioned on the inkjet head side of the paper conveyance path, and a paper support portion that is opposite the cover portion with the paper conveyance path therebetween; and the paper support portion has an inside-projecting part extending further inside widthwise to the conveyance path than the cover portion, and a platen surface for guiding the recording paper passed the printing position formed on the surface of the inside-projecting portion.

10. The inkjet printer described in claim 7, wherein the width of the paper edge covers widthwise to the conveyance path is sized to enable hiding and covering the conveyance holes of the recording paper conveyed by the tractor.

11. The inkjet printer described in claim 10, wherein:

at least one of the pair of tractors can move widthwise to the conveyance path; and movable cover can move widthwise to the conveyance path in conjunction with the movable tractor.

12. The inkjet printer described in claim 11, further comprising:

a cover guide shaft that guides the movable cover widthwise to the conveyance path; and a tractor guide shaft that guides the tractor widthwise to the conveyance path;

wherein the connecting member engages the cover guide shaft in a manner allowing only a specific amount of movement in the paper conveyance direction of the paper conveyance path.

13. The inkjet printer described in claim 10, wherein:

the paper edge covers include a cover portion that is positioned on the inkjet head side of the paper conveyance path, and a paper support portion that is opposite the cover portion with the paper conveyance path therebetween; and the paper support portion has an inside-projecting part extending further inside widthwise to the conveyance path than the cover portion, and a platen surface for guiding the recording paper passed the printing position on the surface of the inside-projecting portion.

14. The inkjet printer described in claim 7, wherein:

the movable platen can move from a guide position guiding the recording paper in a direction separating from the nozzle surface of the inkjet head relative to the guide position, and is held in the guide position by the urging force of a platen urging member.

15. The inkjet printer described in claim 7, wherein:

the movable platen can move widthwise to the conveyance path from a guide position guiding the recording paper, and is held in the guide position by the urging force of a platen urging member.

16. The inkjet printer described in claim 7, wherein:

the movable platen can rock from a guide position that guides the recording paper in a direction separating from the nozzle surface of the inkjet head relative to the guide position on a pivot shaft extending widthwise to the conveyance path, and is held in the guide position by the urging force of a platen urging member.

17. An inkjet printer comprising:

an inkjet head;

a paper conveyance path for conveying recording paper past the printing position of the inkjet head; and a pair of paper edge covers disposed to the paper conveyance path on both widthwise sides thereof at a portion of the paper conveyance path of a specific length at least including the printing position, wherein at least one of the pair of paper edge covers is a movable cover that can move widthwise to the conveyance path, the paper edge covers being covers for covering and hiding the widthwise edge parts of the recording paper from the nozzle surface of the inkjet head as the edges pass the printing position; and a plurality of platens arranged widthwise to the conveyance path for guiding the recording paper past the printing position, wherein at least the platen positioned in the range of movable cover movement is a movable platen that can move when pushed by the movable cover moving widthwise to the conveyance path.

18. The inkjet printer described in claim 17, wherein:

the paper edge covers include a cover portion that is positioned on the inkjet head side of the paper conveyance path, and a paper support portion that is opposite the cover portion with the paper conveyance path therebetween.

19. The inkjet printer described in claim 17, further comprising:

a pair of tractors having a plurality of engaging parts that repeatedly enter and release conveyance holes while moving along an endless track in order to convey recording paper having conveyance holes formed at a specific interval along both widthwise edge parts thereof through the paper conveyance path;

wherein the width of the pair of paper edge covers widthwise to the conveyance path is sized so that the paper edge covers can cover and hide the conveyance holes of the recording paper conveyed by the tractor.

20. The inkjet printer described in claim 19, wherein:

at least one of the pair of tractors is a movable tractor that can move widthwise to the conveyance path; and at least one of the pair of paper edge covers is a movable cover that can move widthwise to the conveyance path in conjunction with the movable tractor.

21. The inkjet printer described in claim 20, further comprising:

a connecting member that connects the movable tractor and the movable cover;

a cover guide shaft that guides the movable cover widthwise to the conveyance path; and a tractor guide shaft that guides the tractor widthwise to the conveyance path;

wherein the connecting member engages the cover guide shaft in a manner allowing only a specific amount of movement in the paper conveyance direction of the paper conveyance path.

22. The inkjet printer described in claim 17, wherein:

the platen located outside the movable range of the movable cover is a stationary platen disposed to a fixed position guiding the recording paper past the printing position.

23. The inkjet printer described in claim 17, wherein:

the paper edge covers include a cover portion that is positioned on the inkjet head side of the paper conveyance path, and a paper support portion that is opposite the cover portion with the paper conveyance path therebetween; and the paper support portion has an inside-projecting part extending further inside widthwise to the conveyance path than the cover portion, and a platen surface for guiding the recording paper past the printing position formed on the surface of the inside-projecting portion.

24. The inkjet printer described in claim 17, further comprising:

a pair of tractors that, in order to convey recording paper having conveyance holes formed at a specific interval along both widthwise edges through the paper conveyance path, have a plurality of engaging members that repeatedly enter and release the conveyance holes while moving along an endless track;

wherein the width of the paper edge covers widthwise to the conveyance path is sized to enable hiding and covering the conveyance holes of the recording paper conveyed by the tractor.

25. The inkjet printer described in claim 24, wherein:

at least one of the pair of tractors can move widthwise to the conveyance path; and at least one of the pair of paper edge covers is a movable cover that can move widthwise to the conveyance path in conjunction with the movable tractor.

26. The inkjet printer described in claim 25, further comprising:

a connecting member that connects the movable tractor and the movable cover;

a cover guide shaft that guides the movable cover widthwise to the conveyance path; and a tractor guide shaft that guides the tractor widthwise to the conveyance path;

wherein the connecting member engages the cover guide shaft in a manner allowing only a specific amount of movement in the paper conveyance direction of the paper conveyance path.

27. The inkjet printer described in claim 24, wherein:

the paper edge covers include a cover portion that is positioned on the inkjet head side of the paper conveyance path, and a paper support portion that is opposite the cover portion with the paper conveyance path therebetween; and the paper support portion has an inside-projecting part extending further inside widthwise to the conveyance path than the cover portion, and a platen surface for guiding the recording paper past the printing position on the surface of the inside-projecting portion.

28. The inkjet printer described in claim 17, wherein:

the movable platen can move from a guide position guiding the recording paper in a direction separating from the nozzle surface of the inkjet head relative to the guide position, and is held in the guide position by the urging force of a platen urging member.

29. The inkjet printer described in claim 17, wherein:

the movable platen can move widthwise to the conveyance path from a guide position guiding the recording paper, and is held in the guide position by the urging force of a platen urging member.

30. The inkjet printer described in claim 17, wherein:

the movable platen can rock from a guide position that guides the recording paper in a direction separating from the nozzle surface of the inkjet head relative to the guide position on a pivot shaft extending widthwise to the conveyance path, and is held in the guide position by the urging force of a platen urging member.

* * * * *